United States Patent [19]

Chiba et al.

[11] Patent Number: 4,690,456

[45] Date of Patent: Sep. 1, 1987

[54] AIR BAG ASSEMBLY

[75] Inventors: Yoshinori Chiba, Yokosuka; Keiichi Ishida, Toyota; Fumio Sugiura, Aichi, all of Japan

[73] Assignees: Aisin Seiki Kabushiki Kaisha; Toyota Jidosha Kabushiki Kaisha, both of Aichi; Kanto Jidosha Kogyo Kabushiki Kaisha, Kanagawa, all of Japan

[21] Appl. No.: 748,860

[22] Filed: Jun. 26, 1985

[30] Foreign Application Priority Data

Jun. 27, 1984 [JP] Japan ..... 59-95369[U]

[51] Int. Cl.[4] ..... A47C 7/46; B60N 1/06

[52] U.S. Cl. ..... 297/284; 297/DIG. 3

[58] Field of Search ..... 297/284, DIG. 3; 5/441, 5/449, 453–456; 24/304, DIG. 11, 90 HA

[56] References Cited

U.S. PATENT DOCUMENTS

| | | | |
|---|---|---|---|
| 1,830,570 | 11/1931 | Smith et al. | 297/DIG. 3 X |
| 2,731,652 | 6/1951 | Bishop . | |
| 3,063,749 | 11/1962 | Struble et al. | 297/218 X |
| 3,253,861 | 5/1966 | Howard | 5/468 X |
| 3,652,126 | 3/1972 | Folling | 5/453 X |
| 3,736,022 | 5/1973 | Radke | 297/DIG. 3 X |
| 3,974,827 | 8/1976 | Bodeen | 297/284 X |
| 4,467,484 | 8/1984 | Nagatake et al. | 297/DIG. 3 X |

FOREIGN PATENT DOCUMENTS

| | | | |
|---|---|---|---|
| 68211 | 1/1983 | European Pat. Off. | 297/DIG. 3 |
| 681658 | 9/1939 | Fed. Rep. of Germany . | |
| 1414920 | 9/1965 | France . | |
| 212789 | 10/1966 | Sweden | 297/452 |

*Primary Examiner*—Peter A. Aschenbrenner
*Assistant Examiner*—Peter R. Brown
*Attorney, Agent, or Firm*—Finnegan, Henderson, Farabow, Garrett & Dunner

[57] ABSTRACT

A lumbar supporting air bag assembly built into a seat back includes a main body consisting of a resilient sheet of synthetic resin sealed together at the side edges thereof, a port provided on the main body for introducing air into and discharging air from the main body, a plurality of partitions formed in the sheet, and longitudinally extending elongate holes or slits formed at the center of the partitions, the latter being separated from one another to define mutually communicating chambers in the air bag assembly. The opposing edges of the slits or holes separate from each other when air under pressure is introduced into the air bag, in such a manner that the holes or slits cause the chambers to be expanded in the direction of a pad.

8 Claims, 5 Drawing Figures

AIR BAG ASSEMBLY

This invention relates to a lumbar supporting air bag assembly provided in a seat back and, more particularly, to an air bag assembly suitable for lumbar support of passengers seated in a vehicle A known air bag assembly disposed in a seat back for lumbar support of a seated person has one or more air bags provided between a pad and an S-shaped spring and inflated with air introduced under pressure An air bag assembly of this type that makes use of one air bag provides only local support of the waist of the passenger, whereas the arrangement making use of a plurality of air bags makes it necessary to provide separate air-pressure circuits for the respective air bags and to arrange the air bags at optimum positions of the seat back. As a result, the air bags cannot be mounted in the seat back with ease and the overall cost is high.

It is known from the specification of U.S. Pat. No. 2,731,652 to provide separate partitions in an air bag to define therein a plurality of chambers which are in communication with one another It has been considered to incorporate the conventional air bag disclosed in the aforementioned U.S. patent in a seat back to solve the above-described problems encountered in the priorart back support. However, when an amount of air sufficient to support the waist of the vehicle passenger is introduced into the air bag having the partitions defining the communicating chambers, the air bag tends to shrink in size in a direction at right angles to the partitions so that the center-to-center distance between the upper and lower chambers becomes smaller than that which prevailed before the injection of the air, so that the supporting center of the air bag is not fixed. This tendency becomes even more pronounced since, in many cases, the shape possessed by the air bag when inflated with air is maintained by the bag even after the air is discharged therefrom.

SUMMARY OF THE INVENTION

Accordingly, an object of the present invention is to provide an air bag assembly which solves the aforementioned problems encountered in the conventional back support.

Another object of the present invention is to provide an air bag assembly in which a partition provided in the air bag is furnished with a slit to prevent the injection of pressured air into the air bag from causing a shift in the point at which the passenger's waist is supported.

Additional objects and advantages of the present invention will be set forth in part in the description that follows and in part will be obvious from the description or may be learned by practice of the invention. These objects and advantages of the invention may be realized and obtained by the apparatus particularly pointed out in the appended claims.

According to the present invention, the foregoing objects are attained by providing a lumbar supporting air bag built into a seat back, comprising a main body consisting essentially of a resilient sheet of synthetic resin sealed together at side edges thereof by heat-sealing or an adhesive,pprt means provided on the main body for introducing air into the main body and for withdrawing air from the main body, and a plurality of partitions formed in the sheet by heat-sealing or adhesion, the partitions being separated from one another and defining mutually communicating chambers in the air bag, each of the partitions being formed to include longitudinally extending elongate holes or slits at the center thereof, the opposing edges of the elongate holes or slits separating from each other when air is introduced under pressure into the air bag, in such a manner that the elongate holes or slits cause the chambers to be expanded in the direction of a pad.

According to another aspect of the present invention, the partitions are extended colinearly transversely of the air bag, and relief holes are provided at both ends of the slits.

According to a further aspect of the present invention, the partitions are arranged in an X-shaped configuration and relief holes are provided at both ends ends of the slits.

Other objects and features of the present invention will become apparent from the following detailed description taken in conjunction with the accompanying drawings.

DESCRIPTION OF THE PREFERRED EMBODIMENT

Figure 1:
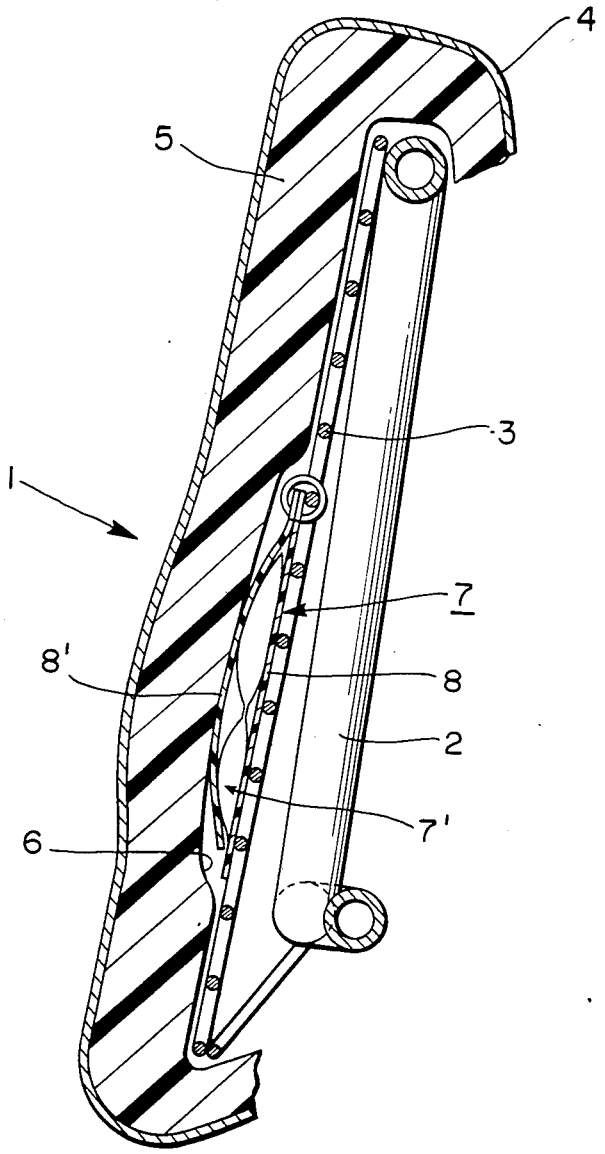
FIG. 1 is a cross-sectional side elevation of a seat back having an air bag assembly according to the present invention.

Reference will now be made in detail to several embodiments of the invention, examples of which are illustrated in the accompanying drawings. Throughout the drawings, like reference characters are used to designated like elements.

FIG. 1 shows a back support or a seat back 1 fitted with a lumbar support. An S-spring 3 is mounted under tension to a pipe frame 2 of the seat back 1 and, ahead of the S-spring 3, a polyurethane pad 5 fitted with a seat cover 4 is provided for forming a seat cover cushion. The polyurethane pad 5 is partially formed with a recess 6 housing an air bag assembly 6 constituting the lumbar support. A device for introducing fluid pressure into the air bag assembly 7 is deleted from the drawings. Plates 8, 8' are arranged in front and in back of an air bag 7'.

FIG. 1 shows the air bag 7' in the inflated state. When fluid pressure is introduced into the air bag 7', the latter is expanded and thrusts the pad 5 forward, thereby increasing the pressure applied to the waist of the seated passenger. The plate 8 serves to prevent expansion of the air bag 7 in the direction of the S-spring 3.

Figure 2:
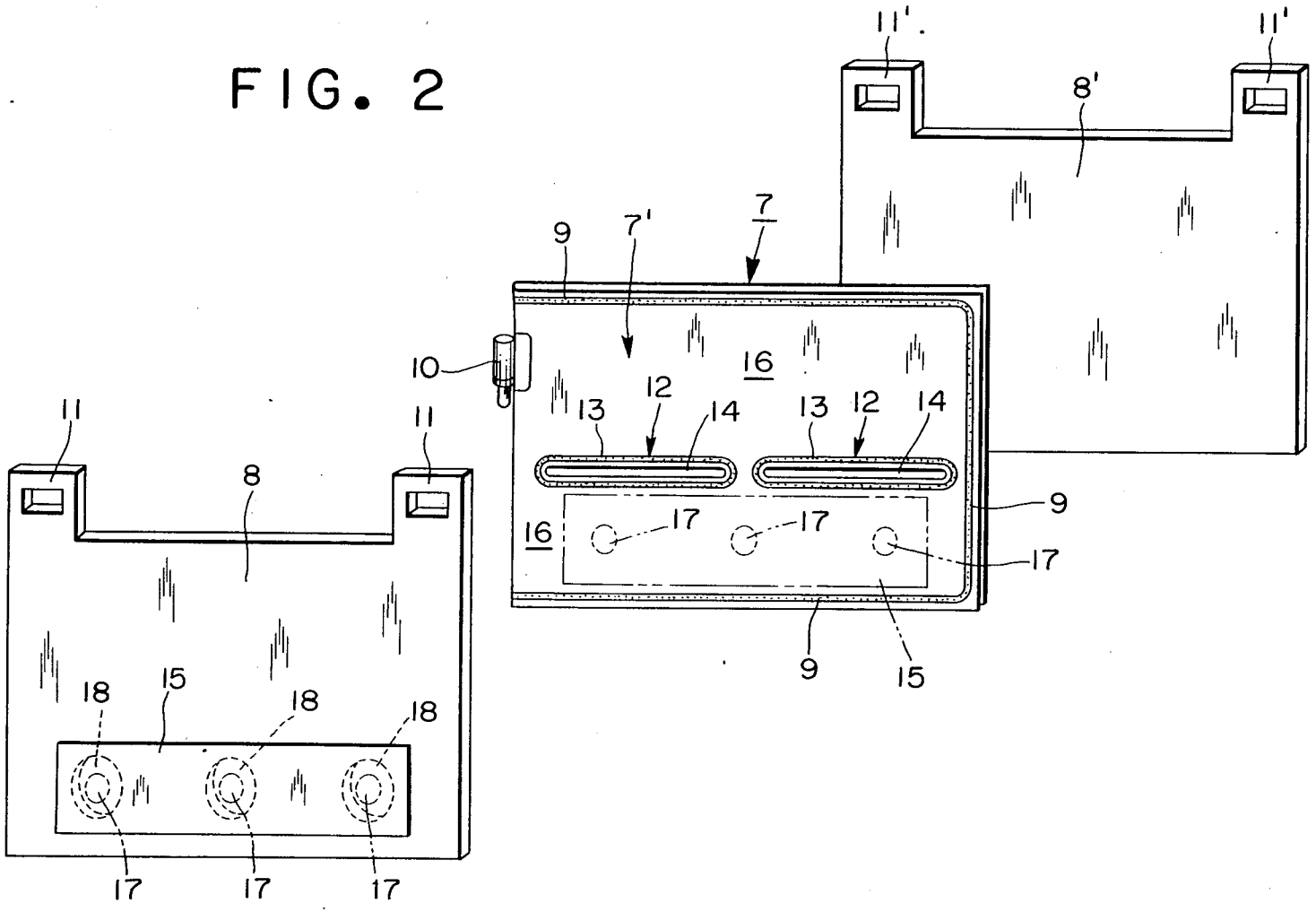
FIG. 2 is an exploded perspective view showing the air bag incorporated in the seat back.

FIG. 2 illustrates the details of the air bag assembly 7. The air bag 7' is a rectangular sheet of synthetic resin such as a urethane film folded on itself with the side edges 9 thereof being sealed together with a heat sealing agent. A port 10 is locally mounted at the folded portion for introducing fluid pressure into the air bag 7' and for withdrawing the fluid pressure therefrom. The air bag 7' is provided with transversely extending partitions 12, each of which comprises an endless bonded portion 13 achieved by heat-sealing or through use of an adhesive. The longitudinal spacing of the bonded portions 13 is about 7 mm. The spacing between the partitions 12 and the spacing between the partitions 12 and the side edge of the main body are each approximately 7 mm. Thus, plural fluid chambers 16 communicating with one another (FIG. 4) are delimited by the partitions 12 in the air bag 7'. Slits or elongated holes 14 are formed at the center of the endless bonded portions 13 and longitudinally of the partitions 12 and, when required, relief holes are formed at the extreme ends of the slits or holes 14.

Figure 3:
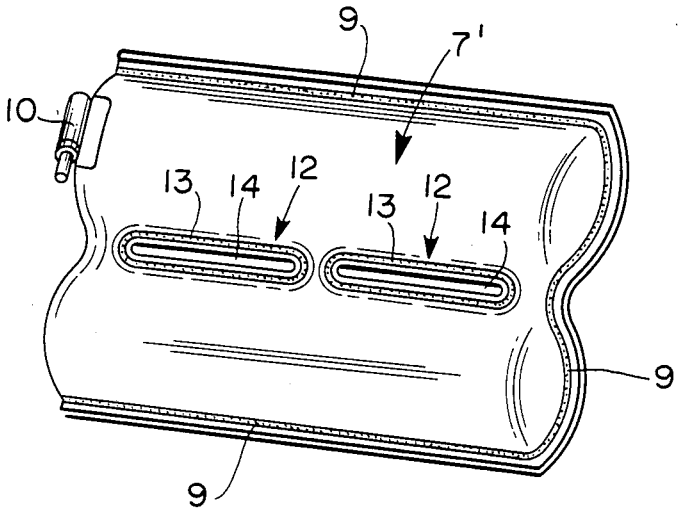
FIG. 3 is a front view of the air bag inflated with air.
Figure 4:
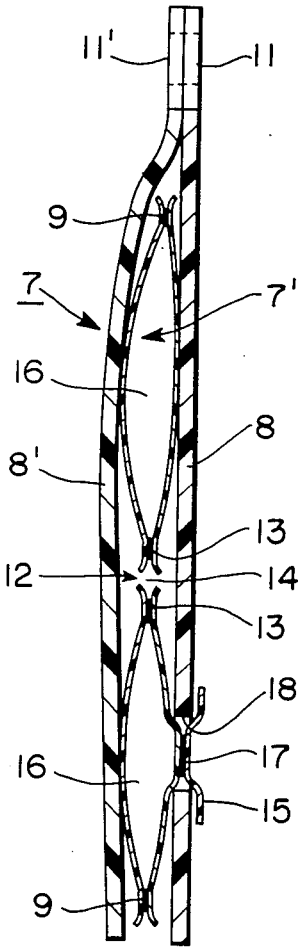
FIG. 4 is a schematic sectional view of the air bag assembly with the air bag thereof inflated with air.

FIGS. 3 and 4 show the air bag 7' assembly in the inflated state. It is evident from these figures that the chambers 16 defined by the partitions 12 become inflated during expansion of the air bag to separate the edges of the slits or holes 14 from one another so that deformation of the corrugations of the air bag 7' is prevented. As a result, the point at which the waist of the seated passenger is supported does not change.

The plate 8 consists of a foamed resin plate and has a pair of mounting lugs 11 provided on the upper portion thereof. The lugs 11 have a hole for engaging with the S-shaped spring 3. The other plate 8' is slightly more resilient than the plate 8 and mounting lugs 11' thereof, which are similar to the lugs 11, are stapled to the mounting lugs 11 of the plate 8 with the lugs 11, 11' aligned with each other. The mounting lugs 11' naturally engage with the S-spring at the same time as the mounting lugs 11.

The manner in which the air bag 7' is mounted on the plate 8 will now be described. A resin sheet 15 disposed at the back surface of the plate 8 is placed in opposition to the air bag 7' through plural holes 18 bored in the plate 8, and portions 17 of the air bag 7' that abut against the sheet 15 are joined together by heat-sealing or through use of an adhesive. As a result, the air bag 7' can be supported by the plate 8.

It should be noted that the plate 8' is effective in uniformly distributing the body weight of the passenger over the air bag 7''.

In a practical example, the main body of the air bag 7' is 170 mm in height and 240 mm in transverse width (inner dimensions), the distance of the center of the partition 12 of the abovementioned size from the lower edge is 65 mm, and the air pressure is 100 mm Hg. The height of the upper chamber 16 and that of the lower chamber 16 in FIG. 4 are 56 mm and 36 mm, respectively, these being sufficient to support the waist of the seated passenger. Air pressure up to a value of 230 mm Hg is possible with the above design.

Figure 5:
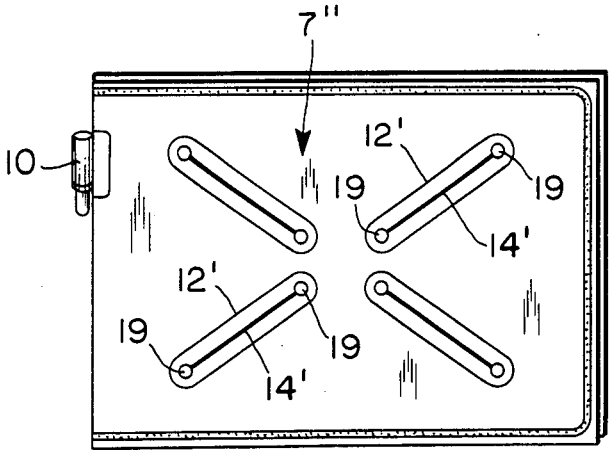
FIG. 5 a front view showing another embodiment of an air bag according to the present invention.

FIG. 5 shows another embodiment of an air bag, designated at numeral 7''. In this embodiment, four partitions are arranged substantially in an X-shaped configuration. A slit 14' is formed at the center of each partition 12' and relief holes 19 are arranged at the extreme ends of each partition 12'. When fluid pressure is introduced into the air bag 7'', two spherical projections are formed transversely at approximately the center of the air bag 7''.

As many apparently widely different embodiments of the present invention can be made without departing from the spirit and scope thereof, it is to be understood that the invention is not limited to the specific embodiments thereof except as defined in the appended claims.

What we claim is:

1. A lumbar supporting air bag built into a seat back, comprising:

a main body consisting essentially of a resilient sheet of synethetic resin sealed together at side edges thereof;

port means provided in said main body for introducing air into said main body and for withdrawing air from said main body;

a plurality of partitions formed in said sheet, said partitions being aligned substantially colinearly and extending transversely along said main body, said partitions being separated from one another and defining mutually communicating upper and lower horizontal chambers in said air bag;

each of said partitions having longitudinally extending elongated holes at the center thereof, wherein opposing edge of said elongate holes separate from each other when air is introdued under pressure into the bag, in such manner that said elongate holes cause said upper and lower chambers to be outwardly expanded;

first and second plates sandwiching said air bag, said first plate having a plurality of apertures aligned with said lower chamber, said first and second plates each having a pair of mounting lugs for mounting said plates on said seat back member, said mounting lugs of each pair being equally spaced along a peripheral portion of said first and second plates on a side of said upper chamber opposite from said lower chamber, said pairs of mounting lugs beig aligned with each other when said plates are mounted on said seat back member;

a resin sheet on the side of said first plate opposite said air bag, said sheet contacting said lower chamber of said air bag through said aperatures in said first plate, wherein the contacting surfaces between the sheet and said lower chamber of said air bag are joined for supporting the air bag on said plates.

2. The air bag according to claim 1 wherein said second plate is more resilient than said first plate.

3. The air bag according to claim 2 wherein said seat back includes meanw for directly supporting an occupant and said second plate is interposed between said supporting means and said air bag.

4. The air bag according to claim 1 wherein said plurality of partitions formed in said sheet are formed by heat-sealing.

5. The air bag according to claim 1 wherein said plurality of partitions formed in said sheet are formed by adhesion.

6. The air bag according to claim 1 wherein the surfaces of abutting contact between the resin sheet and the air bag are joined by heat-sealing.

7. The air bag according to claim 1 wherein the surface of aubtting contact between the resin sheet and the air bag are joined by adhesion.

8. The air bag according to claim 1 wherein said first and second plates are dimensioned to cover the back and front of sasid air bag, respectively.

* * * * *